United States Patent [19]

David

[11] 4,379,701

[45] Apr. 12, 1983

[54] BUOYANT APPARATUS PROPELLED BY A HUMAN OPERATOR

[76] Inventor: Constant V. David, 4952 Field St., San Diego, Calif. 92110

[21] Appl. No.: 246,227

[22] Filed: Mar. 23, 1981

[51] Int. Cl.[3] ..... B63H 16/00

[52] U.S. Cl. ..... 440/21; 440/26; 440/100; 440/90; 416/84

[58] Field of Search ..... 440/100, 90–93, 440/21–32, 98; 416/84–86; 180/7 R, 7.1

[56] References Cited

U.S. PATENT DOCUMENTS

| | | | |
|---|---|---|---|
| 1,349,891 | 8/1920 | Kuznetzoff . | |
| 2,488,310 | 11/1949 | Mayer | 440/100 |
| 2,663,278 | 12/1953 | Skinner . | |
| 2,674,971 | 4/1954 | Therrien | 440/90 |
| 3,001,601 | 9/1961 | Aghnides | 180/7.1 |
| 3,088,732 | 5/1963 | Hetland . | |
| 3,835,494 | 9/1974 | Dougherty | 9/310 D |
| 3,996,872 | 12/1976 | Pinchot | 440/90 |
| 4,016,826 | 4/1977 | Sanders | 115/26 |
| 4,077,351 | 3/1978 | Girona | 440/30 |

*Primary Examiner*—Trygve M. Blix
*Assistant Examiner*—D. W. Keen
*Attorney, Agent, or Firm*—Brown & Martin

[57] ABSTRACT

A buoyant apparatus propelled by a human operator has a pair of side by side annular floats and a pontoon rotatably mounted at the corners of a triangular frame. A pair of platforms are each mounted on the upperside of one of the annular floats. A plurality of paddles are mounted on the undersides of the floats at circumferentially spaced locations. The rotational axes of the floats converge upwardly, and the buoyancy of the floats is such that a person can be buoyantly supported in the water by the apparatus with the outboard portions of the floats raised out of the water sufficiently to result in forward propulsion when the person rotates the adjacent inboard portions of the floats rearwardly. This rotation may be done by the person engaging and rearwardly pushing the inboard portions of the platforms with his or her feet while sitting or standing. Alternatively, the floats may be rotated through a pedal drive operated by the person in a sitting position. The pontoon extends forwardly of the floats in outrigger fashion to impart longitudinal stability. The pontoon may be turned through a steering linkage to permit the apparatus to be guided through the water.

9 Claims, 15 Drawing Figures

BUOYANT APPARATUS PROPELLED BY A HUMAN OPERATOR

BACKGROUND OF THE INVENTION

The present invention relates to human powered buoyant devices, and more particularly, to a buoyant apparatus which is propelled by a human operator in either a standing or sitting position.

Many attempts have been made to devise a practical apparatus which would enable a person to propel him or herself through the water in either a standing or sitting position utilizing a walking movement. Although these devices have taken many forms, they have generally proven unsatisfactory due to various problems such as lack of stability, cumbersomeness, complexity, control difficulty and inadequate buoyancy.

By way of example, U.S. Pat. No. 3,835,494 of Dougherty discloses a pair of foot worn pontoons having flippers and ballast tanks with buoyancy adjusting valves. U.S. Pat. No. 4,016,826 of Sanders discloses a device having four cylindrical floats with paddles which are mounted upon crankshafts having double cranks. The crankshafts are connected by threadle boards operated by a standing person to propel the device forwardly through the water.

U.S. Pat. No. 1,349,891 of Kuznetzoff discloses a swimming device consisting of a pair of buoyant balls having paddles attached thereto. The balls are connected by a crankshaft having a pair of handles which are rotated by a swimmer in order to provide propulsion. U.S. Pat. No. 3,088,732 of Hetland discloses a water roller apparatus including a pair of inflated rubber tubes provided with radially extending paddles about their circumferences. The tubes are held in spaced apart, parallel relationship by a supporting structure. A pair of operators stand inside the structure and cause the device to roll through the water.

U.S. Pat. No. 2,663,278 of Skinner discloses a water craft in which three automobile tire tubes support a bicycle frame. Paddles connected to the bicycle pedals propel the craft forwardly. U.S. Pat. No. 2,488,310 of Mayer discloses a water craft including a pair of rotatable annular floats capable of supporting the craft by their displacement buoyancy. The lower surface of each float is provided with a plurality of vanes or paddles. The rotational axes of the floats are canted so that when the floats are rotated in opposite directions, the submerged paddles propel the craft forwardly while the forwardly moving paddles are clear of the water. The craft is propelled by a motor which rotates the annular floats through a gear drive. Steering is accomplished with a submerged rudder.

SUMMARY OF THE INVENTION

It is the primary object of the present invention to provide a new and improved human propelled buoyant apparatus which overcomes the above noted problems of prior art devices. The apparatus has a pair of side by side annular floats and a pontoon rotatably mounted at the lower corners of a triangular frame. A pair of platforms are each mounted on the upperside of one of the annular floats. A plurality of paddles are mounted on the undersides of the floats at circumferentially spaced locations. The rotational axes of the floats converge upwardly, and the buoyancy of the floats is such that a person can be buoyantly supported in the water by the apparatus with the outboard portions of the floats raised out of the water sufficiently to result in forward propulsion when the person rotates the adjacent inboard portions of the floats rearwardly. This rotation may be done by the person engaging and rearwardly pushing the inboard portions of the platforms with his or her feet while sitting or standing. Alternatively, the floats may be rotated through a pedal drive operated by the person in a sitting position. The pontoon extends forwardly of the floats in outrigger fashion to impart longitudinal stability. The pontoon may be turned through a steering linkage to permit the apparatus to be guided through the water.

BRIEF DESCRIPTION OF THE DRAWINGS

Throughout the figures, like reference numerals refer to like parts unless otherwise indicated.

DESCRIPTION OF THE PREFERRED EMBODIMENT

Figure 1:
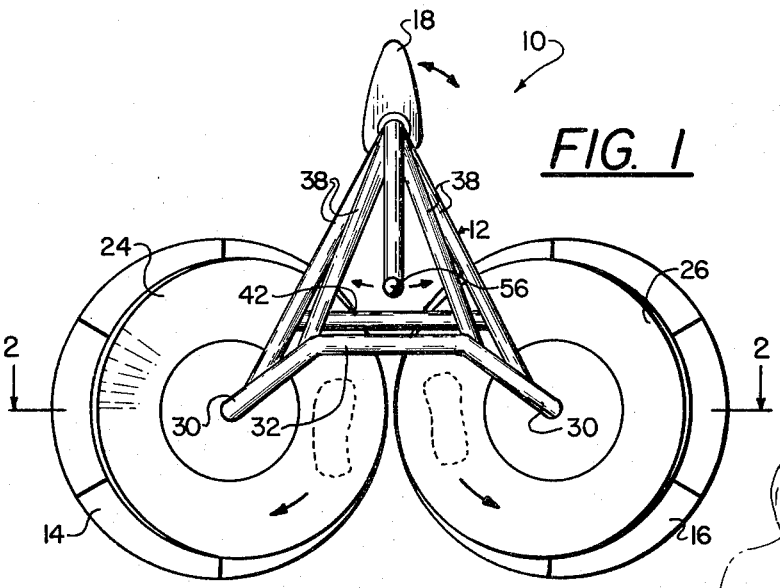
FIG. 1 is a simplified top plan view of a first embodiment of my invention.

Referring to FIG. 1, the first embodiment 10 of my invention includes a frame 12, a pair of buoyant annular floats 14 and 16, and an elongate buoyant pontoon 18. The frame 12 has a generally triangular configuration in horizontal section. The annular floats 14 and 16 and the pontoon 18 are rotatably mounted at the bottom corners of the frame 12 as hereafter described.

Figure 2:
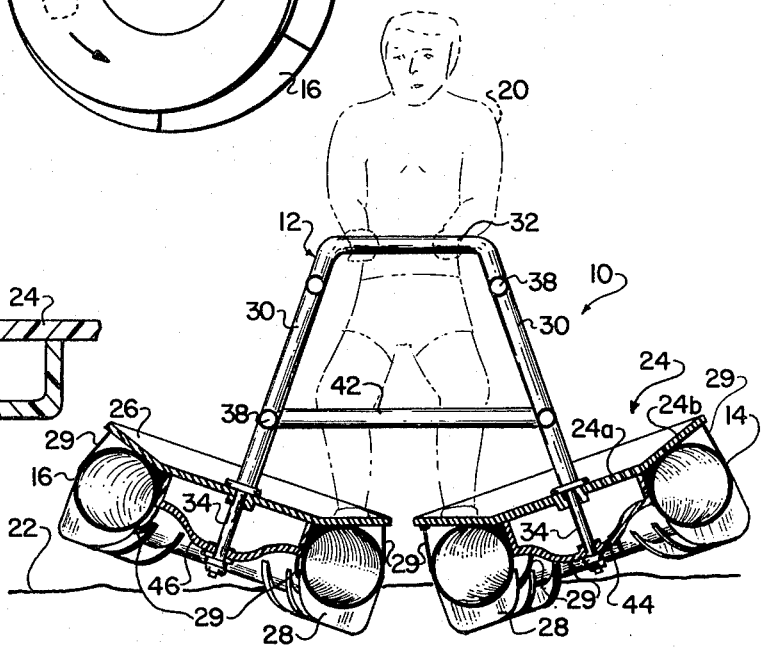
FIG. 2 is a vertical sectional view of the first embodiment taken along line 2—2 of FIG. 1 illustrating a person in phanton lines operating the device in a standing position.
Figure 3:
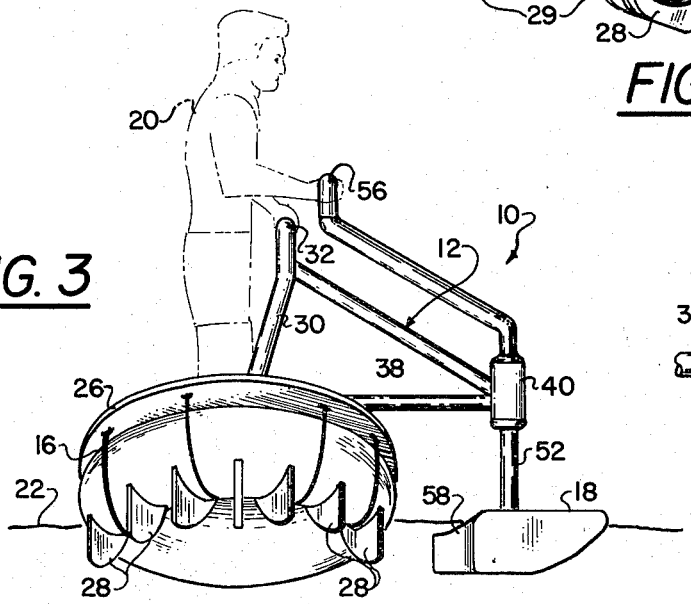
FIG. 3 is a side elevational view of the first embodiment illustrating a person in phantom lines operating the device in a standing position.

As shown in FIGS. 2 and 3, when the apparatus 10 is placed in the water, the displacement buoyancy of the annular floats 14 and 16 and the pontoon 18 is sufficient to support a person 20 in a standing position above the surface of the water 22. The apparatus has substantial stability as a result of the relatively large size of the annular floats in comparison to the size of the person. Furthermore, the longitudinal stability of the device is also enhanced as a result of the outrigger mounting of the pontoon 18. The apparatus is thus buoyantly supported by three spaced apart floating bodies.

As shown in FIGS. 1 and 2, a pair of annular platforms 24 and 26 are each mounted on the upper side of one of the annular floats 14 and 16. A plurality of paddles 28 (FIG. 2) are mounted on the undersides of the annular floats at circumferentially spaced locations. Preferably, each paddle has a planar or slightly convex shape and is affixed to the underside of the float so that it lies in a plane which intersects the axis of rotation of the float.

As best seen in FIG. 2, the annular floats 14 and 16 are rotatably mounted to the frame 12 by means hereafter described in greater detail so that their rotational axes converge upwardly. The annular floats and the platforms mounted on top of the same are positioned in close, side by side proximity so that the left and right feet of the person 20 can be placed on corresponding ones of the platforms as shown in phantom lines at 29 in FIG. 1. The person 20, while grasping the frame 12 with one or two of his or her hands, can walk forwardly on adjacent peripheral portions of the platforms 24 and 26 to rotate the platforms and the annular floats connected thereto in opposite directions as indicated by the arrows in FIG. 1. Preferably, the annular floats are sufficiently canted toward one another and their buoyancy is such that the outboard portions of the floats will be raised out of the water sufficiently to result in forward propulsion through the water. As shown in FIG. 2, the outboard portions of the annular floats and the paddles 28 connected thereto are completely raised out of the water. The rearwardly moving paddles 28 on the adjacent inboard portions of the annual floats thus push water rearwardly resulting in forward movement of the craft. The pontoon 18 is mounted to the frame 12 by means hereafter described in greater detail so that it can be manually rotated by the person 20 in order to steer the apparatus through the water.

The construction of the apparatus 10 may now be described in greater detail. The annular floats 14 and 16 (FIG. 2) may each comprise inflatable tubes made of a flexible material such as plastic or synthetic rubber. By way of example, automobile inner tubes may suffice. Each of the paddles 28 may be made of rigid plastic or synthetic rubber or any other suitable material. The paddles may be affixed to the undersides of the tubes by utilizing adhesive and reinforcing strips or by strapping them to the tubes. The outer peripheral edges of each of the paddles may be curved with the greater area of the paddle being concentrated in the radially outermost region.

Each of the platforms includes an inner disk portion such as 24*a* (FIG. 2) having a diameter substantially equal to the inner diameter of its corresponding inner tube. Each platform may further include an outer ring portion such as 24*b* which overlies the upper side of the tube and is affixed thereto by any suitable means such as circumferentially spaced straps 29 (FIG. 3). The outer ring portion 24*b* (FIG. 2) of each platform is angled sufficiently with respect to the disk portion so that the ring portions together provide substantially horizontal surfaces for the feet of the person 20 as shown in FIG. 2. The amount that the ring portions of the platforms are angled with respect to the disk portions thereof will be determined by the angle between the rotational axes of the tubes 14 and 16. Preferably, the upper surface of the ring portions of each of the platforms is provided with a non-slip textured surface (not shown) to readily enable the person to rotate the platforms with his or her feet through foot contact.

Figure 4:
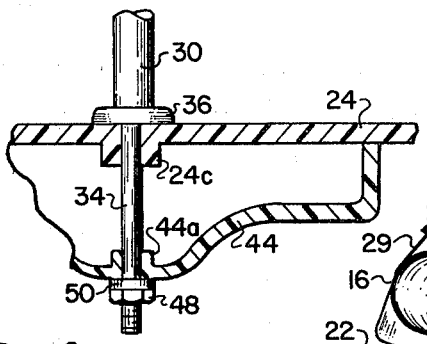
FIG. 4 is an enlarged vertical sectional view of a portion of the first embodiment illustrating the manner in which its floats are rotatably connected to its frame.

The frame 12 includes a pair of tubular legs 30 (FIGS. 2 and 4) whose upper ends are rigidly connected together by a transversely extending handlebar 32 (FIGS. 1 and 2). Preferably, the height of the handlebar 32 is about waist level with respect to the person 20. As shown in FIGS. 2 and 4, each of the platforms 24 and 26 is journaled about a shaft 34 which extends through a central bearing portion 24*c* of the platform and into the lower end of one of the legs 30. Thus, the relative angular position of the legs 30 with respect to one another determines the amount of canting of the annular floats. The upper ends of the shafts 34 are rigidly secured within the legs 30. The lower ends of the leg 30 are each provided with abutment flanges 36 which limit upward movement of the platform and annular float.

Figure 5:
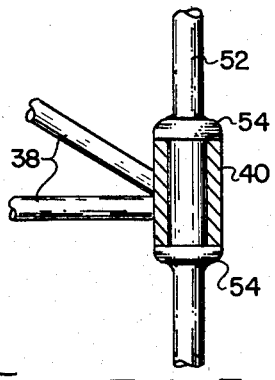
FIG. 5 is an enlarged fragmentary view of another portion of the first embodiment illustrating details of its steering mechanism.

The frame 12 further includes upper and lower pairs of forwardly converging struts 38 (FIGS. 1 and 3). The forwardly converging struts are rigidly secured at vertically spaced points along the legs 30. The forward ends of the struts are rigidly secured to a cylindrical collar 40 (FIG. 5) which forms a portion of the steering mechanism hereafter described. A cross bar 42 (FIG. 1) connects the rearward portions of the lower struts 38 to provide further structural rigidity.

As shown in FIG. 2, a pair of rigid membranes 44 and 46 each extend between the inner walls of one of the tubular floats 14 and 16. As shown in FIG. 4, each of the shafts 34 extends through a bearing portion such as 44*a* in the center of one of the membranes. The lower end of each of the shafts 34 is threaded and a nut such as 48 is threaded over the shaft 34 to retain the membrane and the tube connected thereto in position. The nut is spaced from the membrane by a washer such as 50.

The platform and membrane connected to each tube rotates about a corresponding one of the shafts 34. The outer peripheral edges of the membrane are affixed to the underside of the corresponding platform. The air within each of the chambers defined between each pair of platforms and membranes can aid in buoyantly supporting the apparatus and the person. The membranes may also serve to prevent a large quantity of water from filling the volume defined by the inner walls of the tube which would undesirably increase the mass to be moved.

As shown in FIG. 3, the pontoon 18 is rigidly secured to the lower end of a steering shaft 52 which extends through the cylindrical bore of the collar 40. Retaining washers 54 (FIG. 5) are rigidly secured to the steering shaft 52 immediately above and below the collar 40 to fix the position of the steering shaft. The pontoon 18 is thus rotatable about a substantially vertical steering axis which lies in a plane extending generally perpendicularly to the plane which intersects the rotational axes of the annular floats 14 and 16 (see FIGS. 1 and 3).

As shown in FIG. 3, the upper end of the steering shaft 52 is bend over and terminates in a steering handle 56. The person walking on the floats can thus hold the handlebar 32 with one hand and grasp the steering handle 56 with the other hand as required. Transverse movement of the steering handle 56 will rotate the pontoon 18 in the water which then acts as a rudder. Thus, the aforementioned structure provides a steering linkage for permitting the person to direct the apparatus as it is propelled through the water. Preferably, the forward end of the pontoon is pointed and the aft end of the pontoon is provided with a fin 58 (FIG. 3) to enhance the steering action.

Figure 6:
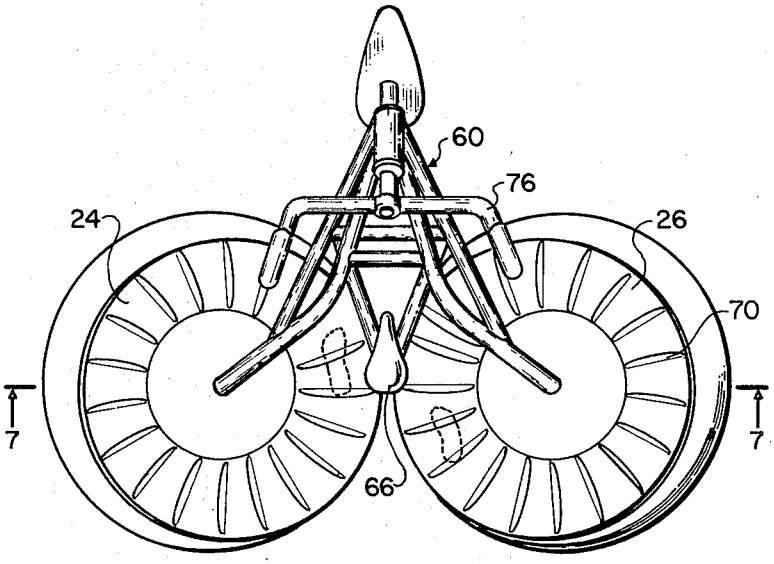
FIG. 6 is a simplified top plan view of a second embodiment of my invention.
Figure 9:
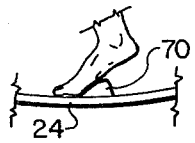
FIG. 9 is an enlarged view of a portion of one of the platforms of the second embodiment illustrating the manner in which one of the person's feet engages one of a plurality of radially extending ribs on the platform.
Figure 7:
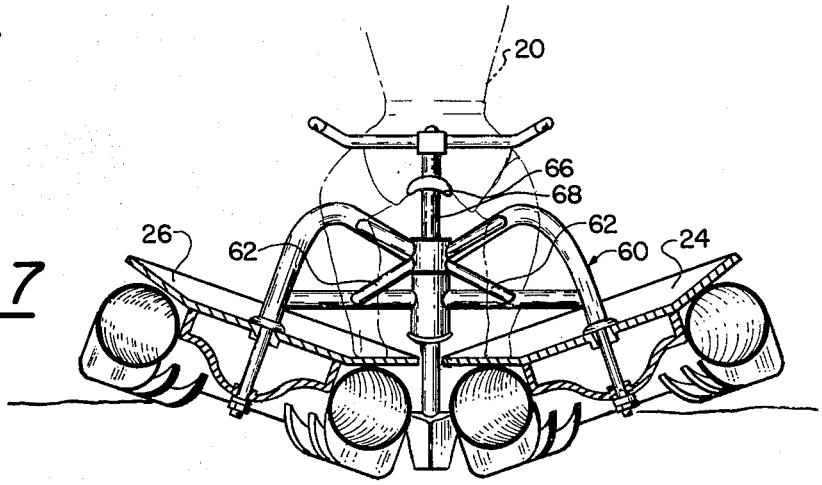
FIG. 7 is a vertical sectional view of the second embodiment taken along line 7—7 of FIG. 6 illustrating part of a person in phantom lines operating the device in a seated position.
Figure 8:
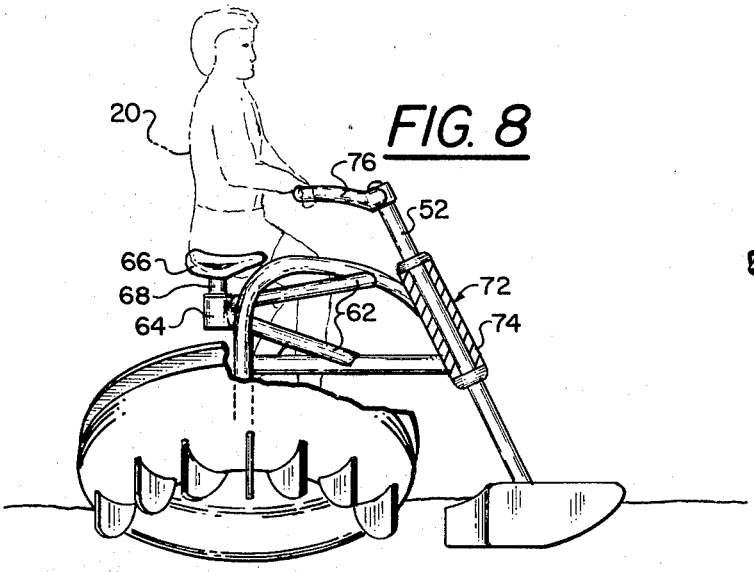
FIG. 8 is a side elevational view of the second embodiment illustrating a person in phantom lines operating the device in a seated position.

A second embodiment of my invention is illustrated in FIGS. 6–10. It is similar in overall construction to the first embodiment just described, except that the second embodiment has modifications which permit a person to propel the apparatus while sitting. Specifically, referring FIGS. 6, 7 and 8, the second embodiment includes a modified frame 60 having four rearwardly converging support members 62 connected at their rearward ends to a cylindrical sleeve 64 (FIG. 8). A saddle 66 is connected to the upper end of a post 68 whose lower end is secured in the sleeve 64. Preferably, the height of the saddle 66 is such that the person 20 can comfortably sit on the saddle as shown in FIGS. 7 and 8 and rearwardly move the inboard portions of the platforms 24 and 26 with his or her feet. As shown in FIG. 6, each of the platforms 24 and 26 is provided with a plurality of circumferentially spaced, radially extending ribs 70. As shown in FIG. 9, each of the ribs 70 has a wedge-like configuration and is adapted to be engaged by one of the person's feet to aid in rearwardly propelling the inboard portions of the platforms and the inner tubes connected thereto.

Figure 10:
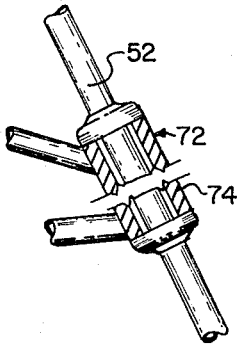
FIG. 10 is an enlarged fragmentary view of another portion of the second embodiment illustrating details of its steering mechanism.

As shown in FIGS. 8 and 10, the steering mechanism 72 of the second embodiment is configured to permit convenient operation thereof by the seated person 20. Specifically, the collar 74 of the steering mechanism is connected to the frame 60 at a rearwardly inclined angle and a pair of handlebars 76 are connected to the upper end of the steering shaft 52 at a height so that they can be readily grasped by the person 20 as shown in FIG. 8.

Figure 11:
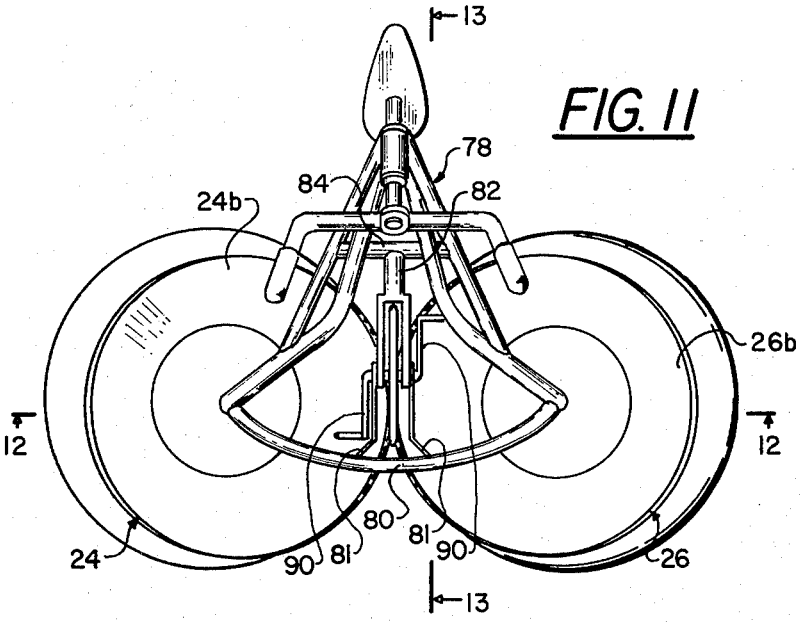
FIG. 11 is a simplified top plan view of a third embodiment of my invention which is propelled through a pedal drive. In this view, the saddle and its supporting structure have been removed.
Figure 14:
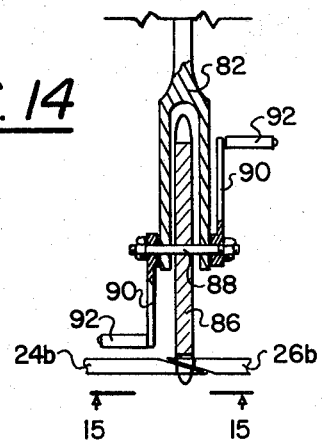
FIG. 14 is an enlarged fragmentary view of the pedal drive of the third embodiment.
Figure 12:
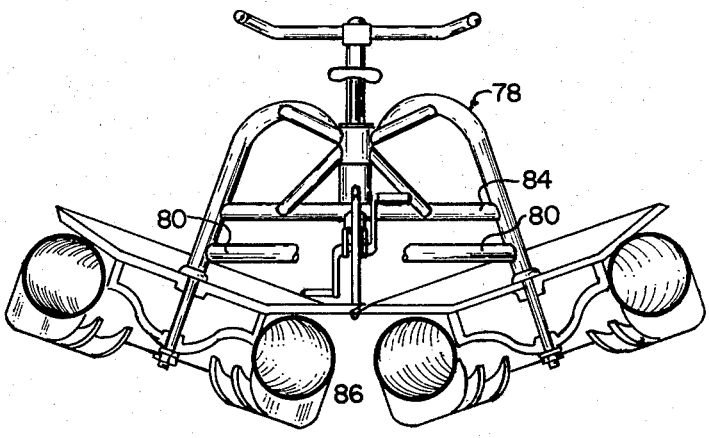
FIG. 12 is a fragmentary vertical sectional view of the third embodiment taken along line 12—12 of FIG. 11. The saddle and its supporting structure are shown in this view.
Figure 13:
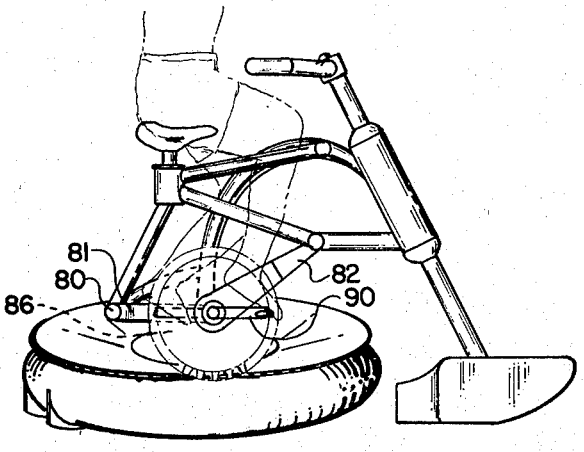
FIG. 13 is a vertical sectional view of the third embodiment taken along line 13—13 of FIG. 11 illustrating part of a person in phantom lines seated on the saddle pedaling the device.

FIGS. 11–15 illustrate a third embodiment of my invention. It is similar to the second embodiment of my invention just described except that the third embodiment is adapted to be propelled through a pedal drive. Referring to FIG. 11, the third embodiment includes a frame 78 similar to the frame of the second embodiment. However, in addition, the frame 78 includes a curved, transversely extending support member 80 which rigidly holds the platforms 24 and 26 a predetermined distance apart. In addition, the frame 78 includes a fork 82 whose neck is rigidly connected to a cross bar 84 of the frame. The fork is rigidly connected to the member 80 by a pair of rods 81. As shown in FIG. 14, a sprocket 86 is rotatably supported on an axle 88 between the legs of the fork 82. A pair of oppositely extending crank arms 90 are connected to opposite ends of the axle 88 and a pair of pedals 92 are each rotatably mounted on the horizontally extending portion of each of the crank arms.

Figure 15:
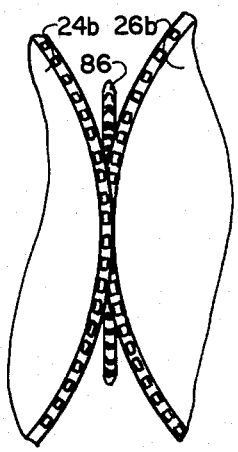
FIG. 15 is an enlarged view of the gear drive of the platforms taken along line 15—15 of FIG. 14.

As best shown in FIG. 15 in the third embodiment, the outer ring portions **24*b* and 26*b* of the platforms have a plurality of circumferentially spaced, generally rectangular apertures therein adjacent their peripheries. Furthermore, the outer ring portions 24*b* and 26*b* are positioned so that they overlap. Corresponding apertures in the ring portions are in alignment when they are aligned with a line extending between the rotational axes of the floats. The teeth of the sprocket 86 are configured to extend through these aligned apertures. A person such as 20 seated on the apparatus can thus rotate the sprocket 86 by pushing the pedals 92** with his or her feet. The intermeshing relationship between the teeth of the sprocket and the apparatus in the peripheries of the platforms will thus permit such pedaling to propel the inboard portions of the floats in a rearwardly direction.

Having described preferred embodiments of the human propelled buoyant apparatus, it should be apparent to those skilled in the art that my invention can be modified in arrangement and detail. Therefore, the protection afforded my invention should be limited only in accordance with the scope of the following claims.

I claim:

1. A buoyant apparatus adapted to be propelled by a human operator comprising:

a frame;

a pair of buoyant annular floats;

a pair of annular platforms, each mounted on the upper side of a corresponding float;

a plurality of paddles mounted on the under sides of the floats at circumferentially spaced locations thereon;

means for rotatably mounting the floats to the frame with their rotational axes converging upwardly, the convergence of the axes and the buoyancy of the floats being such that a person can be buoyantly supported in the water by the apparatus with the outboard portions of the floats raised out of the water sufficiently to result in forward propulsion of the apparatus when the person rotates the adjacent inboard portions of the platforms rearwardly; and steering means for enabling the person to direct the apparatus through the water, including an elongate buoyant pontoon, means for mounting the pontoon to the frame for rotation about a substantially vertical axis, and a steering linkage connected to the pontoon mounting means for permitting the person to grasp and move the linkage to turn the pontoon.

2. An apparatus according to claim 1 wherein:

the platforms have outer ring portions which overlap each other, the ring portions having a plurality of circumferentially spaced apertures formed therein;

a sprocket supporter connected to the frame;

a sprocket rotatably supported by the sprocket supporter and having teeth which mesh with the apertures in the ring portions of the platforms where they overlap;

a pair of oppositely extending crank arms connected to the sprocket for rotating the same;

a saddle; and means connected to the frame for supporting the saddle in a position so that the person's feet can rotate the crank arms when the person is seated on the saddle.

3. An apparatus according to claim 1 wherein the steering means further comprises:

a fin mounted to one end of the pontoon.

4. An apparatus according to claim 1 wherein the annular floats each comprise inflatable tubes, and wherein each paddle is affixed to its corresponding tube so that it lies in a plane which intersects the rotational axis of the tube.

5. An apparatus according to claim 4 wherein each platform includes an inner disk portion having a diameter substantially equal to the inner diameter of its corresponding tube and an outer ring portion overlying the tube and angled sufficiently with respect to the disk portion to provide a substantially horizontal surface for engagement by a foot of the person.

6. An apparatus according to claim 4 and further comprising a pair of membranes each extending between the inner walls of its corresponding tube.

7. An apparatus according to claim 1 wherein the frame has a generally triangular configuration, and the annular floats and steering means are located at the corners of the frame.

8. An apparatus according to claim 1 and further comprising:

a saddle; and means connected to the frame for supporting the saddle in a position so that the person's feet can engage and rearwardly rotate the adjacent inboard portions of the platforms when the person is seated on the saddle.

9. An apparatus according to claim 8 and further comprising a plurality of circumferentially spaced, radially extending ribs connected to the upper side of each of the platforms, each rib adapted to be engaged by one of the person's feet to facilitate rotation of its corresponding platform.

* * * * *